US006814018B1

(12) United States Patent
Chuo

(10) Patent No.: US 6,814,018 B1
(45) Date of Patent: Nov. 9, 2004

(54) AUTOMATIC THREAD CUTTING APPARATUS FOR SEWING MACHINES

(75) Inventor: Jui-Jung Chuo, Taipei Hsien (TW)

(73) Assignee: Shing Ray Sewing Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 10/694,840

(22) Filed: Oct. 29, 2003

(51) Int. Cl.[7] ..... D05B 65/00
(52) U.S. Cl. ..... 112/292; 112/300
(58) Field of Search ..... 112/285, 291, 112/292, 296, 298, 300, 301, 253; 83/202, 856, 901, 936, 910, 950

(56) References Cited

U.S. PATENT DOCUMENTS 4,077,342 A * 3/1978 Steckenrider ..... 112/292
4,098,208 A * 7/1978 Hedegaard ..... 112/291
4,589,362 A * 5/1986 Dusch ..... 112/292
5,775,246 A * 7/1998 Wen ..... 112/292
6,378,448 B1 * 4/2002 Hunang ..... 112/298

* cited by examiner

*Primary Examiner*—Ismael Izaguirre
(74) *Attorney, Agent, or Firm*—Birch, Stewart, Kolasch & Birch, LLP

(57) ABSTRACT

An automatic thread cutting apparatus for sewing machines to cut off a thread and hold the remaining portion of bottom yarns after sewing operation is completed includes a thread cutter, a linkage mechanism and a driver. The thread cutter includes a cutting blade and an upper and a lower fixed blade. The cutting blade has a first cutting section and a second cutting section. When the driver provides power to drive the linkage mechanism, the cutting blade is swung between the upper and lower fixed blades. The thread is cut off by the first cutting section and the bottom yarns are cut off by the second cutting section and held for use in the successive sewing operation without the need of redoing yarn threading.

12 Claims, 7 Drawing Sheets

AUTOMATIC THREAD CUTTING APPARATUS FOR SEWING MACHINES

FIELD OF THE INVENTION

The present invention relates to an automatic thread cutting apparatus for sewing machines and particularly to a thread cutting apparatus that holds the yarn during yarn cutting after sewing operation has been completed for use in successive operations.

BACKGROUND OF THE INVENTION

At present sewing technologies are quite mature. Adopted these technologies, textile industry is able to produce high quality clothes and garments at fast speed and lower costs to benefit people. Refer to FIGS. 1 and 2 for a conventional thread cutting apparatus used in sewing machines. It includes a first movable blade 61, a second movable blade 62, a first fixed blade 63 and a second fixed blade 64. The first movable blade 61 is for hooking a thread (not shown in the drawings). The first fixed blade 63 cuts off the thread. The second movable blade 62 is for hooking a bottom yarn, and the second fixed blade 64 cuts off the bottom yarn, then the bottom yarn (not shown in the drawings) is held. It needs two blades to cut off the thread and bottom yarn. The first and second movable blades 61 and 62, and the first and second fixed blades 63 and 64 are fastened to the bottom of a plate 65. When adjusting the angles of the movable blades 61 and 62, and fixed blades 63 and 64 is required, the plate 65 has to be removed, and the adjustment is performed on the plate 65. After the adjustment is completed, the plate 65 is reassembled on a sewing deck (not shown in the drawings) of the sewing machine again. If the plate 65 is not properly aligned and reassembled, the adjusted angles could be invalid. It causes a lot of inconveniences.

SUMMARY OF THE INVENTION

Therefore the primary object of the invention is to provide a thread cutting apparatus for sewing machines that employs a novel chain movement to drive the cutting mechanism of the sewing machines. The thread cutting apparatus according to the invention includes:

- a thread cutter which consists of a cutting blade and fixed blades. The cutting blade and the fixed blades are mounted onto the top section of a sewing deck of the sewing machine. The fixed blades include an upper fixed blade and a lower fixed blade that are stacked over each other and spaced by a gap there between. The cutting blade may be swung through the upper and lower fixed blades to cut off the yarn. The cutting blade has a first cutting section to cut off the thread and a second cutting section to cut off the bottom yarn and clamp the remained portion of the bottom yarn. The first and second cutting sections have respectively a notch. The notch of the second cutting section is deeper than the notch of the first cutting section;
- a linkage mechanism which consists of a direction switch section, a first crank lever, a second crank lever, and a first and a second linkage bar that are interconnected with each other by said order. The second linkage bar is connected to the cutting blade; and
- a driver which drives the linkage mechanism moving in two directions to move the thread cutter to cut off the yarn. The driver is mounted on a bracing section, which is connected to a direction switch section of the linkage mechanism.

Another object of the invention is to provide a thread cutting apparatus that is easy to adjust and align. The thread cutter is directly mounted onto the sewing deck and covered by the plate. Adjustment of the cutting blade and fixed blades may be accomplished directly on the sewing deck to avoid errors.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
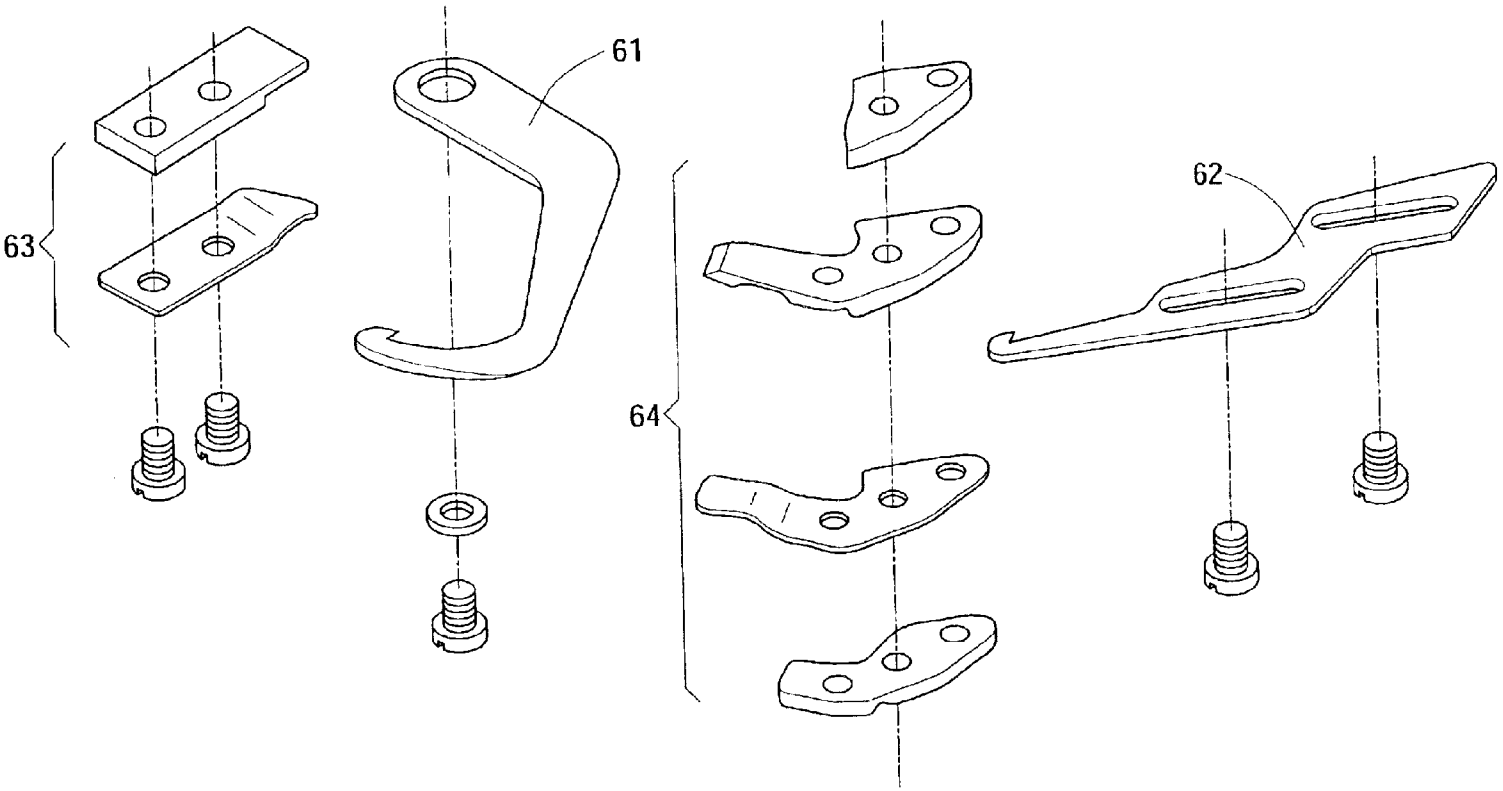
Fig.1 PRIOR ART
FIG. 1 is an exploded view of a thread cutting apparatus of a conventional sewing machine.
Figure 2:
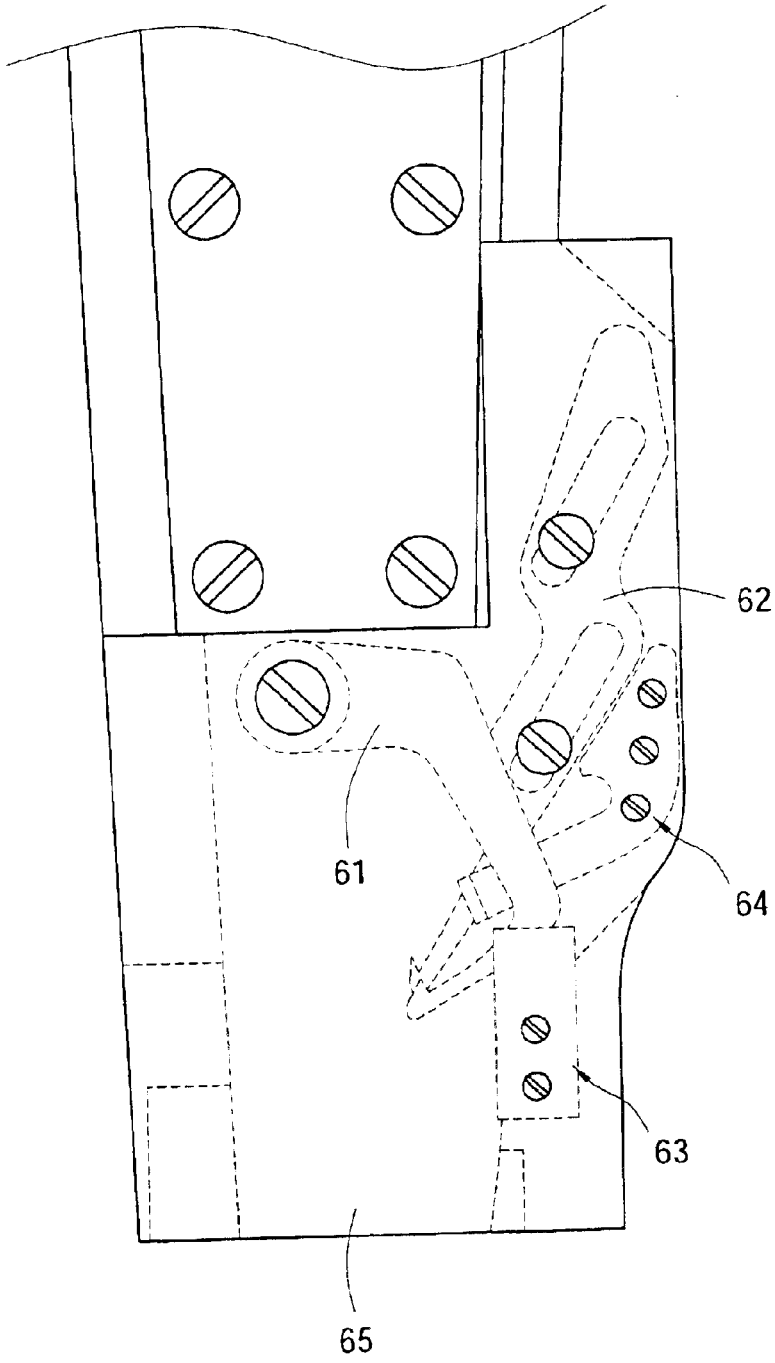
Fig.2 PRIOR ART
FIG. 2 is a top view of a thread cutting apparatus of a conventional sewing machine.
Figure 3:
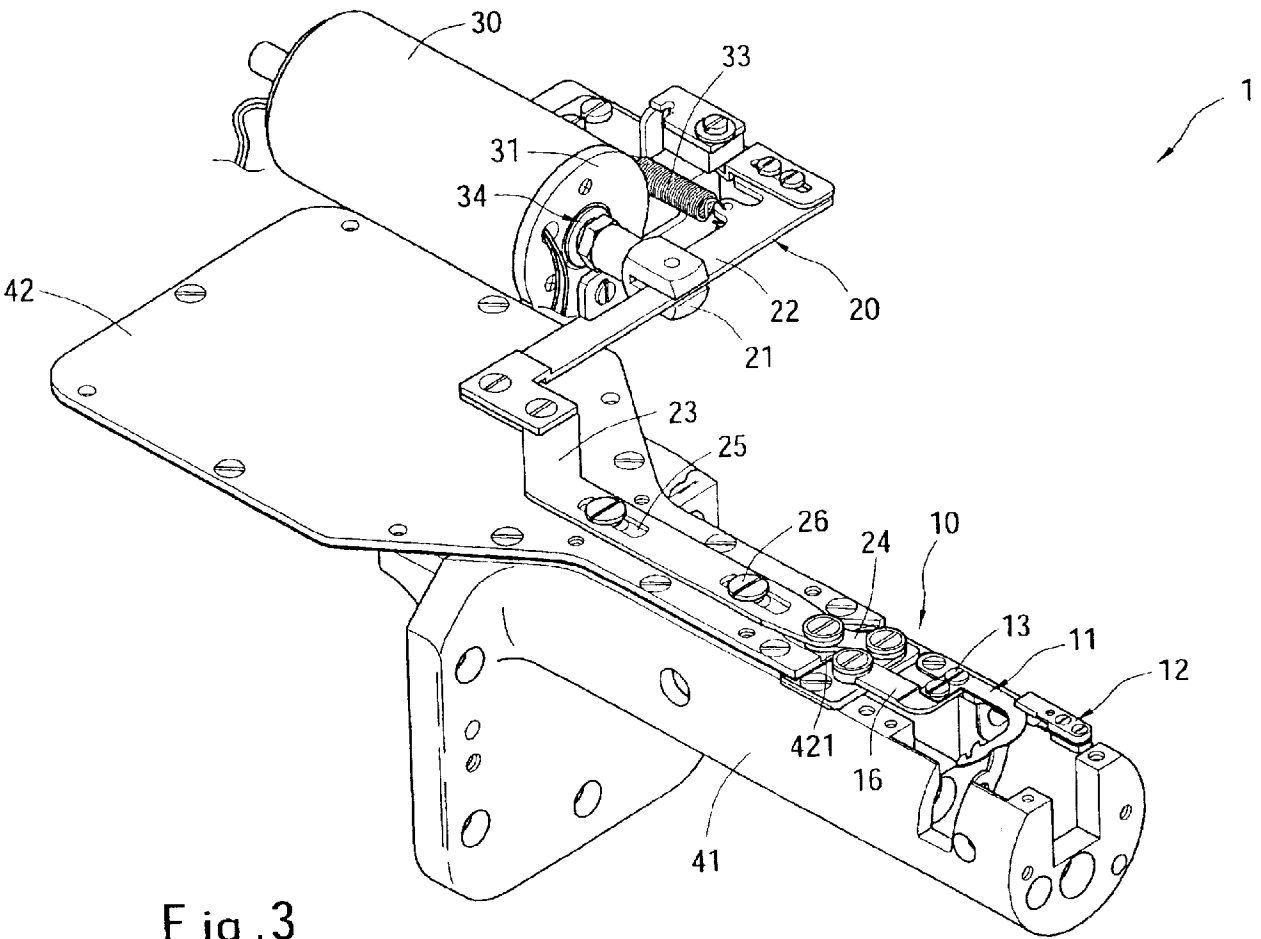
FIG. 3 is a perspective view of the present invention.

Please referring to FIG. 3, the automatic thread cutting apparatus 1 according to the invention includes a thread cutter 10, a linkage mechanism 20 and a driver 30. The driver 30 is located on a bracing section 31 to provide driving power and drive the linkage mechanism 20 to operate. The linkage mechanism 20 moves the thread cutter 10 to cut off threads 50 and a yarn 51(as shown intherebetween FIG. 6A).

Figure 4:
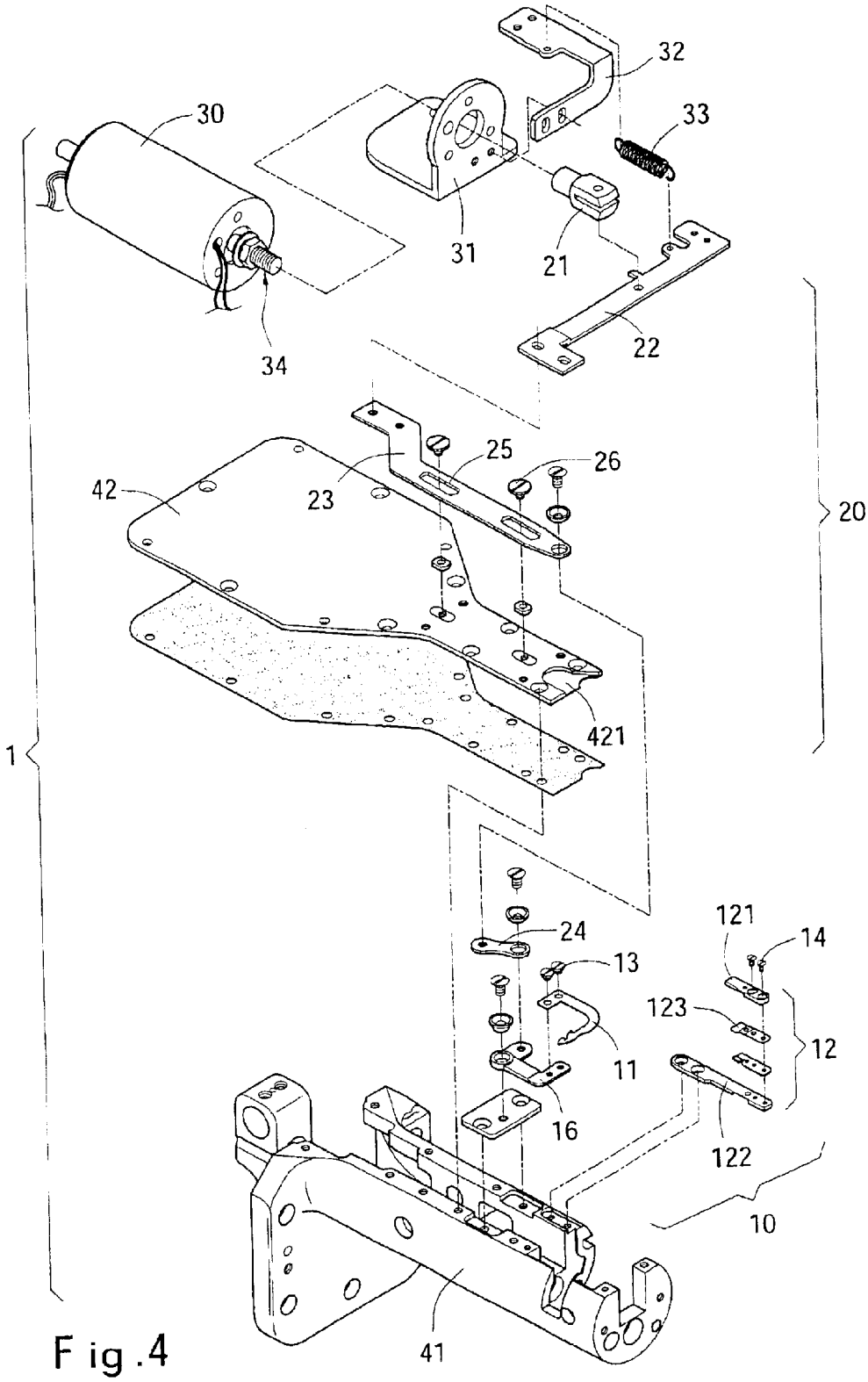
FIG. 4 is an exploded view of the present invention.
Figures 6A, 6B:
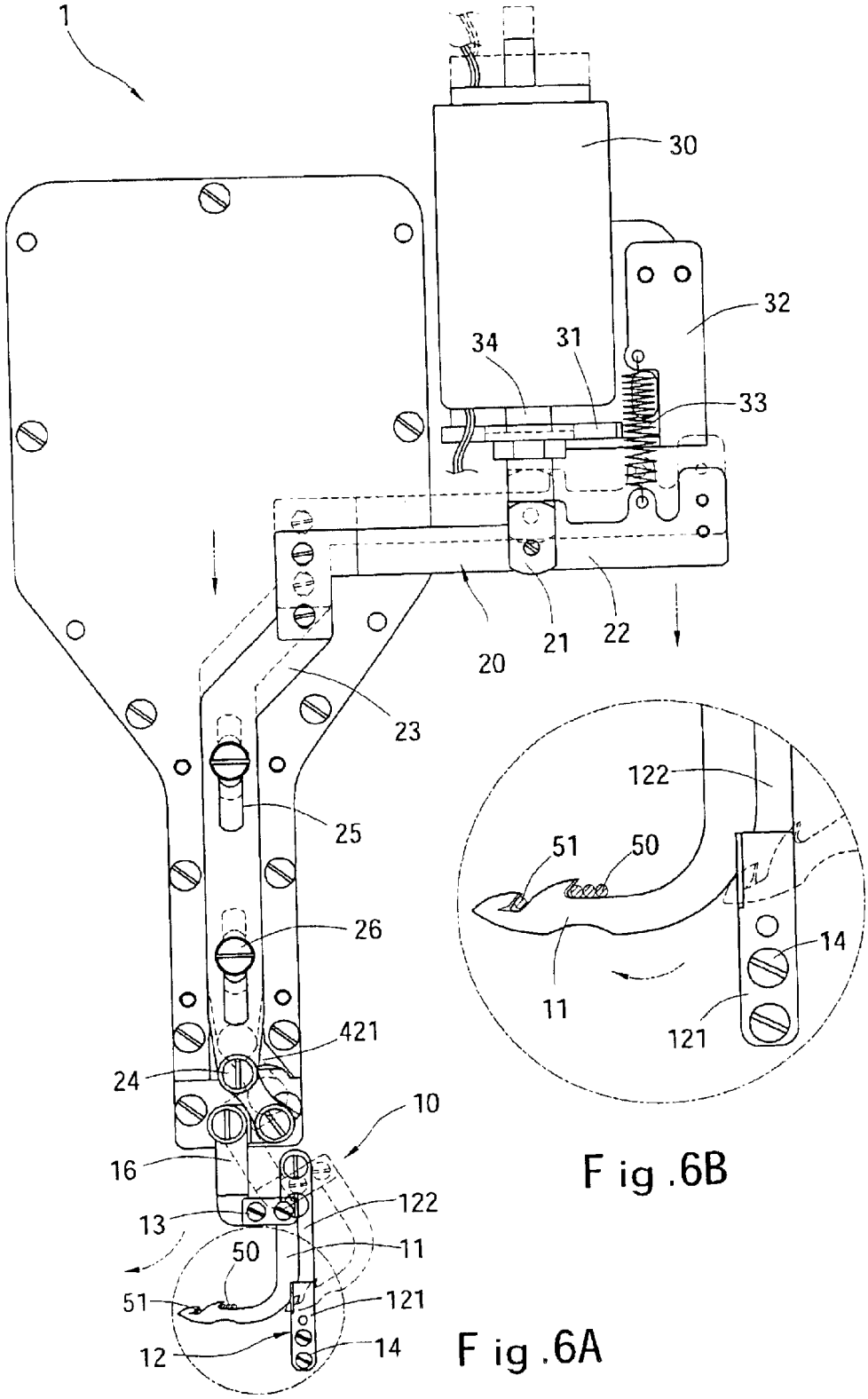
FIG. 6A is a top view of the thread cutting operation according to the invention.
FIG. 6B is a fragmentary enlarged view of FIG. 6A.
Figures 6C, 6D:
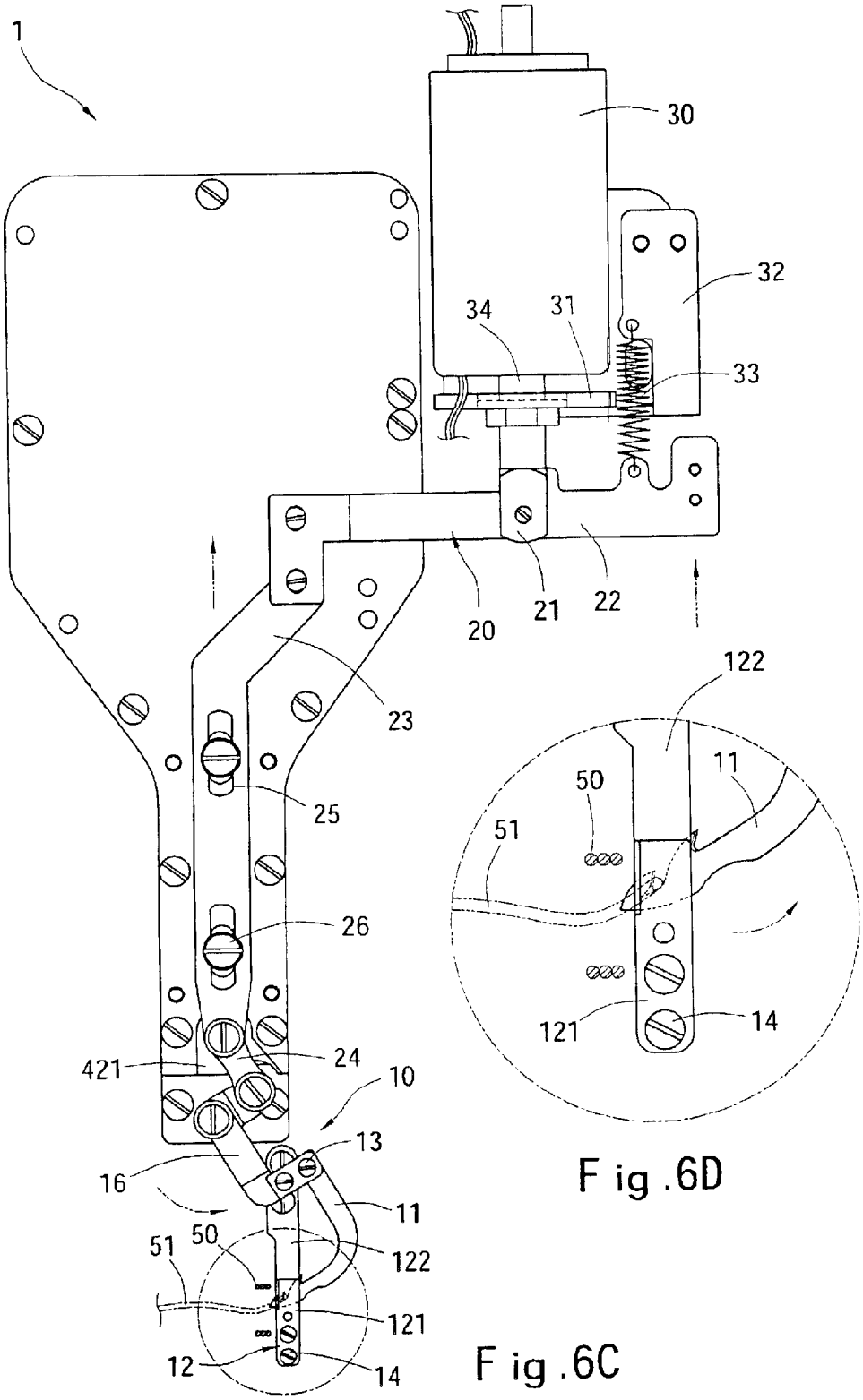
FIG. 6C is a top view of another thread cutting operation according to the invention.
FIG. 6D is a fragmentary enlarged view of FIG. 6C.

Referring to FIG. 4, the driver 30 may be a bi-directional solenoid to drive the linkage mechanism 20 moving continuously in two directions and drive the thread cutter 10 to cut off threads 50 and a yarn 51(as shown in FIG. 6A). The driver 30 is mounted onto the bracing section 31 and has a moving section 34 coupling with a direction switch section 21 of the linkage mechanism 20. The bracing section 31 is connected to a damper plate 32 which is connected to an elastic element 33 to cushion shock. The elastic element 33 is a spring or an elastic reed. In this embodiment it is a spring.

The linkage mechanism 20 consists of the direction switch section 21, a first crank lever 22, a second crank lever 23, a first linkage bar 24 and a second linkage bar 16. The direction switch section 21 has one end normally connecting to one end of the first crank lever 22. The first crank lever 22 is connected normally to the second crank lever 23. The second crank lever 23 is connected to the first linkage bar 24. Finally the first linkage bar 24 is connected to the second linkage bar 16. The second linkage bar 16 is connected to a cutting blade 11. The second crank lever 23 has a slot 25 and is fastened to a platen 42 through a fastener 26. The fastener 26 is a screw or a rivet. In this embodiment it is a screw.

The slot 25 enables the second crank lever 23 to slide. The second linkage bar 16 is formed substantially in a horse shoe shape and drives the cutting blade 11 in a swing manner between the first and second fixed blades 121 and 122 to cut off threads 50 and a yarn 51(as shown in FIG. 6A). In addition, the sewing machine has a sewing deck 41 with the platen 42 located on the top section thereof. The platen 42 has a sliding trough 421 on the front end to enable the first linkage bar 24 to slide thereon.

Figure 5:
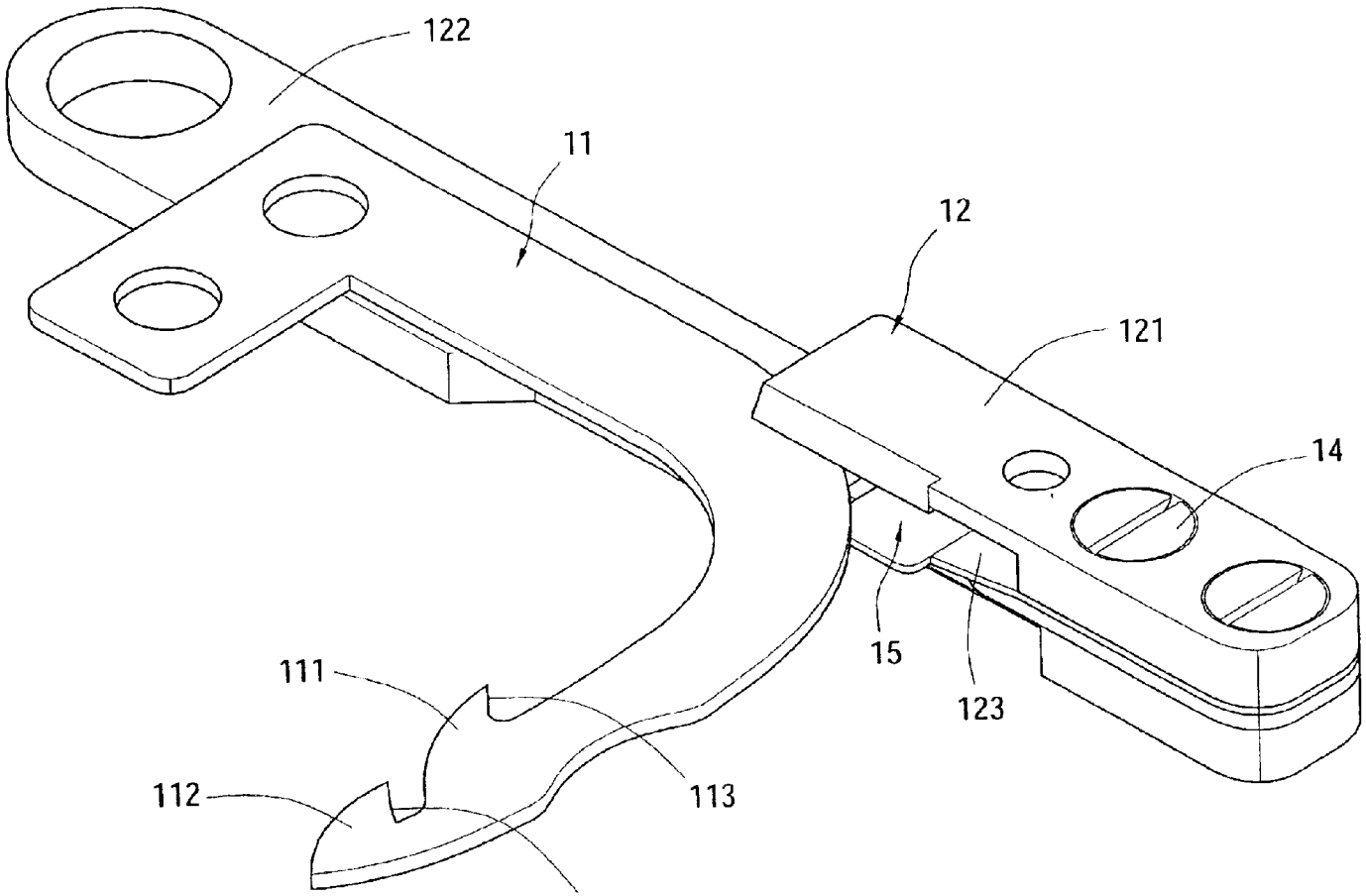
FIG. 5 is an enlarged perspective view of the thread cutter of the invention.

The thread cutter 10 includes the cutting blade 11 and fixed blades 12. The cutting blade 11 is mounted onto the top section of the sewing deck 41 through fasteners 13. The fixed blades 12 are fastened to the front end of the sewing deck 41 through fasteners 14. The fixed blades 12 include a upper fixed blade 121 and a lower fixed blade 122 that are stacked over each other and sandwiched by a pad 123 to form a gap 15 therebetween (as shown in FIG. 5) thereby the cutting blade 11 can pass through to cut off threads 50 and a yarn 51(as shown in FIG. 6A). Moreover, the cutting blade 11 has a first cutting section 111 and a second cutting section 112 (as shown in FIGS. 4 and 5). The first cutting section 111 is to cut off the thread 50, and the second cutting section 112 is to cut of the bottom yarns 51 and clamps the remained portion of the bottom yarns 51. The first and second cutting sections 111 and 112 have respectively a first notch 1 13 and a second notch 1 14. The second notch 114 of the second cutting section 112 is deeper than the first notch 113 of the first cutting section 111.

Referring to FIGS. 5, 6A through 6D, the driver 30 provides a continuous and bi-directional movement. When it drives the moving section 34 rearwards, the direction switch section 21 is moved rearwards, and the first crank lever 22 connected the direction switch section 21 is moved rearwards, the second crank lever 23 which connects to the first crank lever 22 also is moved rearwards, and the first linkage bar 24 which connects to one end of the second crank lever 23 also is moved rearwards, hence the first linkage bar 24 is moved in the sliding trough 421 and drives the second linkage bar 16 turning clockwise, and the cutting blade 11 is swung clockwise between the upper and lower fixed blades 121 and 122. Meanwhile, the thread 50 is located in the first notch 113 of the first cutting section 111 and cut off by the upper and lower blades 121 and 122. While the bottom yarn 51 is cutted off by the second cutting section 112 in the deeper second notch 114, the remaining portion of the bottom yarn 51 is held. When the driver 30 drives the moving section 34 forwards, the linkage motions are opposite to when have been depicted above, and the cutting blade 11 is moved slightly outwards counterclockwise.

While the preferred embodiments of the invention have been set forth for the purpose of disclosure, modifications of the disclosed embodiments of the invention as well as other embodiments thereof may occur to those skilled in the art. Accordingly, the appended claims are tended to cover all embodiments which do not depart from the spirit and scope of the invention.

What is claimed is:

1. An automatic thread cutting apparatus for sewing machines to cut off yarns and hold the remaining portion of the yarns after sewing operation is completed for use in successive operations, comprising:

a thread cutter including a cutting blade and fixed blades located on a top section of a sewing deck of a sewing machine, said fixed blades including a upper fixed blade and a lower fixed blade that are stacked over each other to form a gap therebetween to allow said cutting blade to pass through for cutting off the yarns, said cutting blade having a first cutting section for cutting off the yarns and a second cutting section to couple with said fixed blades to hold the remaining portion of the yarns;

a linkage mechanism including a direction switch section, a first crank lever, a second crank lever, a first linkage bar and a second linkage bar, the direction switch section having one end connecting to one end of said first crank lever, said first crank lever being connected to said second crank lever, said second crank lever being connected to said first linkage bar, said first linkage bar being connected to said second linkage bar, said second linkage bar being connected to said cutting blade; and a driver mounted onto a bracing section having a moving section coupling with the directing switch section of said linkage mechanism for driving said linkage mechanism to move reciprocally and driving said thread cutter to cut off the yarns.

2. The automatic thread cutting apparatus of claim 1, wherein said bracing section is fastened to a damper plate which is connected to an elastic element to cushion shock.

3. The automatic thread cutting apparatus of claim 2, wherein said elastic element is a spring.

4. The automatic thread cutting apparatus of claim 2, wherein said elastic element is an elastic reed.

5. The automatic thread cutting apparatus of claim 1, wherein said second crank lever is connected to the first linkage bar through a fastener.

6. The automatic thread cutting apparatus of claim 5, wherein said fastener is a screw.

7. The automatic thread cutting apparatus of claim 5, wherein said fastener is a rivet.

8. The automatic thread cutting apparatus of claim 1, wherein said cutting blade is formed in a hook and connected to said second linkage bar to be swung between said upper and said lower fixed blades to cut off the yarns.

9. The automatic thread cutting apparatus of claim 1, wherein said upper and said lower fixed blades are interposed by a pad to form said gap.

10. The automatic thread cutting apparatus of claim 1, wherein said driver is a bidirectional solenoid.

11. The automatic thread cutting apparatus of claim 1, wherein said first cutting section and said second cutting section have respectively a first notch and a second notch, said second notch of said second cutting section being deeper than said first notch of said first cutting section.

12. The automatic thread cutting apparatus of claim 1, wherein said cutting blade and said fixed blades are fastened to a top section of said sewing deck of said sewing machine through fasteners.

* * * * *